US006834812B2

(12) United States Patent
Neretti et al.

(10) Patent No.: US 6,834,812 B2
(45) Date of Patent: Dec. 28, 2004

(54) FUEL INJECTOR WITH PIEZOELECTRIC ACTUATOR

(75) Inventors: Massimo Neretti, San Lazzaro di Savena (IT); Michele Petrone, San Lazzaro di Savena (IT); Andrea Ricci, San Michele (IT); Cecilia Lamberti, Bologna (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 225 days.

(21) Appl. No.: 10/140,451

(22) Filed: May 7, 2002

(65) Prior Publication Data

US 2003/0006300 A1 Jan. 9, 2003

(30) Foreign Application Priority Data

May 8, 2001 (IT) ..... BO2001A0280

(51) Int. Cl.[7] ..... B05B 1/08; B05B 1/30; F02M 39/00

(52) U.S. Cl. ..... 239/102.2; 239/533.3; 239/585.1; 239/585.3; 239/585.5; 239/8

(58) Field of Search ..... 239/102.1, 102.2, 239/88–92, 533.2, 533.3, 533.7, 533.8, 533.9, 585.1, 585.2, 585.3, 585.4, 585.5, 900; 251/129.21, 129.15, 127

(56) References Cited

U.S. PATENT DOCUMENTS

| | | | | |
|---|---|---|---|---|
| 4,579,283 A | * | 4/1986 | Igashira et al. | 239/88 |
| 4,784,102 A | * | 11/1988 | Igashira et al. | 123/447 |
| 4,803,393 A | * | 2/1989 | Takahashi | 310/328 |

FOREIGN PATENT DOCUMENTS

| | | |
|---|---|---|
| DE | 199 09 451 | 9/2000 |
| DE | 100 02 720 A1 | 3/2001 |
| DE | 199 47 779 A1 | 4/2001 |
| DE | 199 50 762 A1 | 4/2001 |
| EP | 0 790 402 A2 | 8/1997 |
| JP | 62-228664 | 10/1987 |
| JP | 10-9084 | 1/1998 |

OTHER PUBLICATIONS

Copy of European Search Report mailed Aug. 28, 2002.

* cited by examiner

*Primary Examiner*—Davis Hwu
(74) *Attorney, Agent, or Firm*—Baker & Daniels

(57) ABSTRACT

Fuel injector provided with a piezoelectric actuator, a valve activated by the piezoelectric actuator and regulating a fuel supply that flows in a working direction, and a mechanical transmission placed between the piezoelectric actuator and the valve; an expansion of the piezoelectric actuator displaces the valve in the working direction from a closed position to an open position in an opposite direction to that of the fuel outlet.

10 Claims, 4 Drawing Sheets

FUEL INJECTOR WITH PIEZOELECTRIC ACTUATOR

The present invention relates to a fuel injector with piezoelectric actuator.

BACKGROUND OF THE INVENTION

Fuel injectors with piezoelectric actuators have been available for many years now, i.e. fuel injectors provided with a valve that is displaced in a working direction between a closed position and an open position for activating a piezoelectric actuator.

Known piezoelectric actuators, for example of the type described in patent application DE19909451, comprise a fixed frame and an actuator body made of piezoelectric material arranged in alignment with a working direction; the actuator body has a lower base, which is arranged close to the valve, is mechanically linked to the valve itself, and is free to slide with respect to the fixed frame in the working direction, and has an upper base, which is opposite the lower base and is linked to the fixed frame. In use, the actuator body is excited with an electrical field in order to cause it to expand in the working direction and therefore displace the valve in the working direction from the closed position to the open position, in a direction in accordance with the fuel outlet direction. However, such a structure requires that in order for the valve to move from the closed position to the open position, it is displaced towards the outside of the injector putting itself into a configuration that can cause the injector to be soiled, and therefore its functions impaired.

SUMMARY OF THE INVENTION

The objective of the present invention is to produce a fuel injector with piezoelectric actuator, which does not have the drawbacks described above and, in particular, is easy and inexpensive to implement.

According to the present invention, a fuel injector with piezoelectric actuator is produced in accordance with claim 1.

BRIEF DESCRIPTION OF THE DRAWINGS

The present invention will now be described with reference to the attached drawings, which give a non-exhaustive illustration of a few embodiments of the invention, as follows.

DETAILED DESCRIPTION OF THE INVENTION

Figure 1:
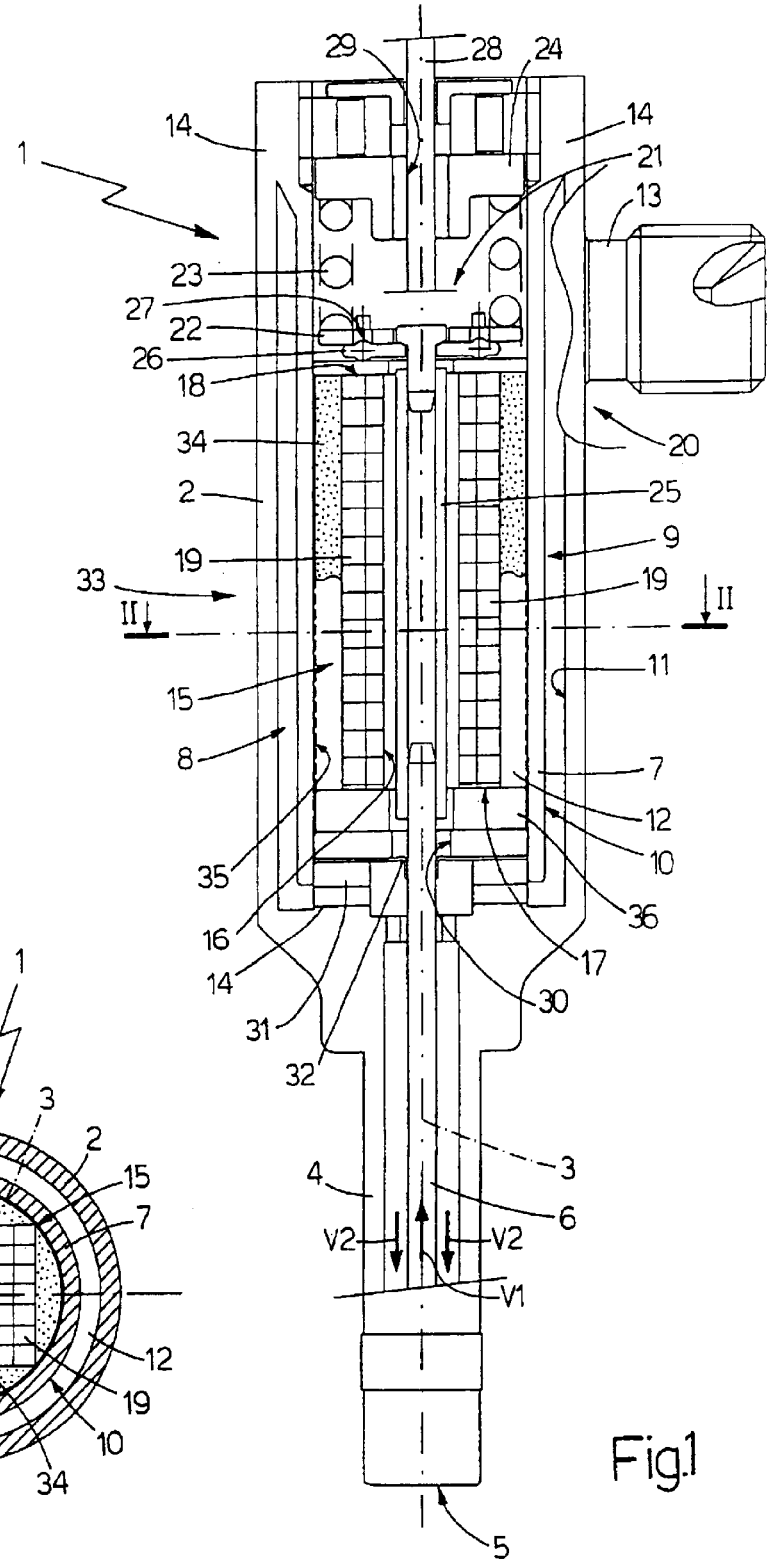
FIG. 1 is a diagrammatic view, in side elevation and partial section, of a fuel injector produced according to the present invention.
Figure 2:
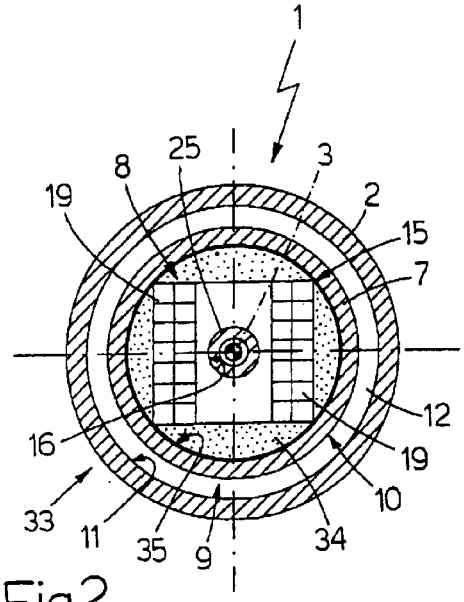
FIG. 2 is a section, along the line II—II and with a few portions removed for clarity, of the injector in FIG. 1.

In FIGS. 1 and 2, the reference number 1 indicates a fuel injector as a whole, which comprises a container 2 substantially cylindrical in shape, having a central axis of symmetry 3 and a circular section; in correspondence with a lower end of the container 2 there is attached an injection pipe 4, which is in the form of a cylindrical tube and ends in an injection port 5 regulated by a valve 6 that is moveable along the axis 3 between a closed position and an open position. Inside the container 2 there is arranged, coaxially with the axis 3, a container 7, which is cylindrical in shape, has a circular section and is provided with an internal chamber 8 that houses a piezoelectric actuator 9 capable of activating the valve 6, i.e. capable of displacing the valve 6 between the aforementioned closed and open positions.

The container 7 has a diameter, i.e. a dimension transverse to the axis 3, that is smaller than the container 2 so as to constitute, between the outer lateral surface 10 of the container 7 and the inner lateral surface 11 of the container 2, an annular channel 12 through which the fuel can flow freely in a direction parallel to the axis 3 until it reaches the mouth of the injection pipe 4; in particular, the fuel is supplied under pressure to an upper portion of the annular channel 12 through a supply pipe 13 ending inside the container 2.

The container 7 is integral with the container 2 by way of a contact zone 14 produced by welding or similar, so that the container 7 constitutes a fixed frame for the piezoelectric actuator 9; the piezoelectric actuator 9 comprises an actuator body 15 made of piezoelectric material, which is arranged in alignment with the axis 3, is provided with a central hole 16 in alignment with the axis 3, has a lower base 17 arranged close to the valve 6 and linked to the container 7, and has an upper base 18 opposite the lower base 17, which is free to slide with respect to the container 7 along the axis 3.

As illustrated in FIGS. 1 and 2, the actuator body 15 is defined by two components 19 made of piezoelectric material, physically separated from one another and arranged symmetrically about the central axis 3. According to another embodiment, not illustrated, the actuator body 15 is constituted [by] a single tubular component made of piezoelectric material arranged coaxially to the axis 3.

Between the mobile upper base 18 and the valve 6 there is placed a mechanical transmission 20 provided with mobile equipment 21, which is arranged in contact with the upper base 18 and is connected rigidly to the valve 6; in particular, the mobile equipment 21 comprises a plate 22, which is transverse to the axis 3, bears against the upper base 18 and is kept bearing against the upper base 18 itself by the pressure exerted along the axis 3 by a spring 23 compressed between the plate 22 and an upper portion 24 of the container 7. A rod 25 is integral with the plate 22, which rod is arranged inside the hole 16 along the axis 3 and is connected rigidly to the valve 6.

Between the plate 22 and the upper base 18 there is placed an annular body 26 provided with a spherical contact surface 27, so as to make the plate 22 floating with respect to the base 18 in order to be free to perform small oscillations about an axis perpendicular to the axis 3; these small free oscillations are necessary in order to allow the plate 22 to absorb without deformation, and therefore without breaking due to fatigue, any expansion differences in the components 19 made of piezoelectric material.

In order to drive the actuator body 15, electric voltage is supplied to the actuator body 15 itself via an electric cable 28, which passes through an appropriate open hole 29 in the upper portion 24 of the container 7, through the central zone of the spring 23, and through an open hole (not illustrated) in the plate 22; the electric cable 28 passes through the open hole (not illustrated) in the plate 22 with a certain amount of play to allow movement of the plate 22 along the axis 3 with respect to the electric cable 28.

In use, when the actuator body 15 is non-excited, i.e. is not subject to an electrical field, the valve 6 is in the aforementioned closed position in that it is pushed downwards along the axis 3 by the pressure exerted by the spring 23 and transmitted to the valve 6 by the plate 22 and the rod 25.

When the actuator body 15 is excited, i.e. is subject to an electrical field, the actuator body 15 itself expands along the axis 3; for the purposes of this expansion the lower base 17 stays still, since it is linked to the container 7, while the upper base 18 performs an upward displacement along the axis 3, which displacement is transmitted to the valve 6 by the plate 22 and the rod 25 and causes a displacement of the valve 6 along the axis 3 from the aforementioned closed position to the aforementioned open position.

As stated above, it is clear that the valve 6 is displaced along the axis 3 from the aforementioned closed position to the aforementioned open position in an opposite direction V1 to that V2 in which fuel leaves the supply pipe 13; therefore, in order to move from the closed position to the open position, the valve 6 is displaced towards the inside of the supply pipe 13, putting itself in a configuration that reduces the soiling, and therefore impairment of the functions, of the injector 1.

The internal chamber 8 of the container 7 is produced in such a way that it is isolated from the fuel; for this purpose the outer lateral surface 10 of the container 7 is continuous and has no opening, and the hole 30 in the lower portion 31 of the container 7, to allow connection between the valve 6 and the rod 25, is provided with a deformable holding component 32.

The container 7 is made of sheet metal with a high thermal transmission coefficient; furthermore, the container 7 is provided with exchange means 33 capable of increasing heat exchange between the fuel and the piezoelectric actuator 9.

As illustrated in FIGS. 1 and 2, the actuator body 15 has smaller dimensions than the dimensions of the chamber 8, and the exchange means 33 comprise a plurality of transmission means 34 made of heat-conducting material, which have a shape and dimensions so as to be arranged between the actuator body 15 and an inner lateral surface 35 of the container 7 so as to increase heat transmission between the actuator body 15 and the container 7. In particular, each transmission body 34 is arranged in contact with either the actuator body 15 or the inner lateral surface 35 of the container 7.

In an embodiment not illustrated, the exchange means 33 also comprise finning of the outer lateral surface 10 of the container 7 bathed in the fuel.

As stated above, it is clear that the piezoelectric actuator 9 is arranged inside the chamber 8, which is isolated from the fuel and has its outer lateral surface 10 bathed in the fuel itself; this configuration is particularly advantageous, since it makes it possible either to keep the piezoelectric actuator 9 isolated from the fuel, protecting the piezoelectric actuator 9 itself from the corrosive and soiling action of the fuel, or to ensure, in a simple and extremely economical manner, continuous cooling of the piezoelectric actuator 9 by transmitting the heat produced by the piezoelectric actuator 9 inside the chamber 8 to the fuel lapping the outer lateral surface 10.

Furthermore, the use of the transmission bodies 34 makes it possible either to increase heat transmission from the piezoelectric actuator 9 to the container 7, or to ensure correct positioning of the piezoelectric actuator 9 inside the chamber 8, since the transmission bodies 34 also have the function of filling the empty spaces inside the chamber 8 itself.

In a preferred embodiment, the injector 1 is provided with at least one compensation component 36 having thermal expansion capable of compensating for the various heat expansions of the actuator body 15 and the mechanical transmission 20; in other words, through the combined effect of its own dimensions and thermal expansion coefficient (positive or negative), the compensation component 36 has heat expansion that cancels out all the various heat expansions of the actuator body 15 and the mechanical transmission 20.

The compensation component 36 can be integrated into the container 7, can be placed between the container 7 and the actuator body 15 (as illustrated in FIG. 1), or can be integrated into the mobile equipment 21.

In a preferred embodiment, the compensator component 36 is made of metal with a low thermal expansion coefficient, particularly Invar.

Figure 3:
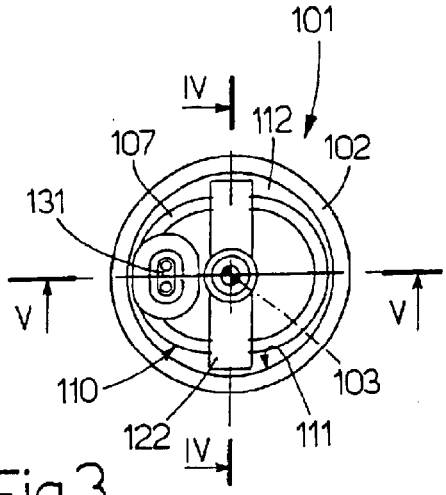
FIG. 3 is a diagrammatic view from above and in section of a different embodiment of a fuel injector produced according to the present invention.
Figure 5:
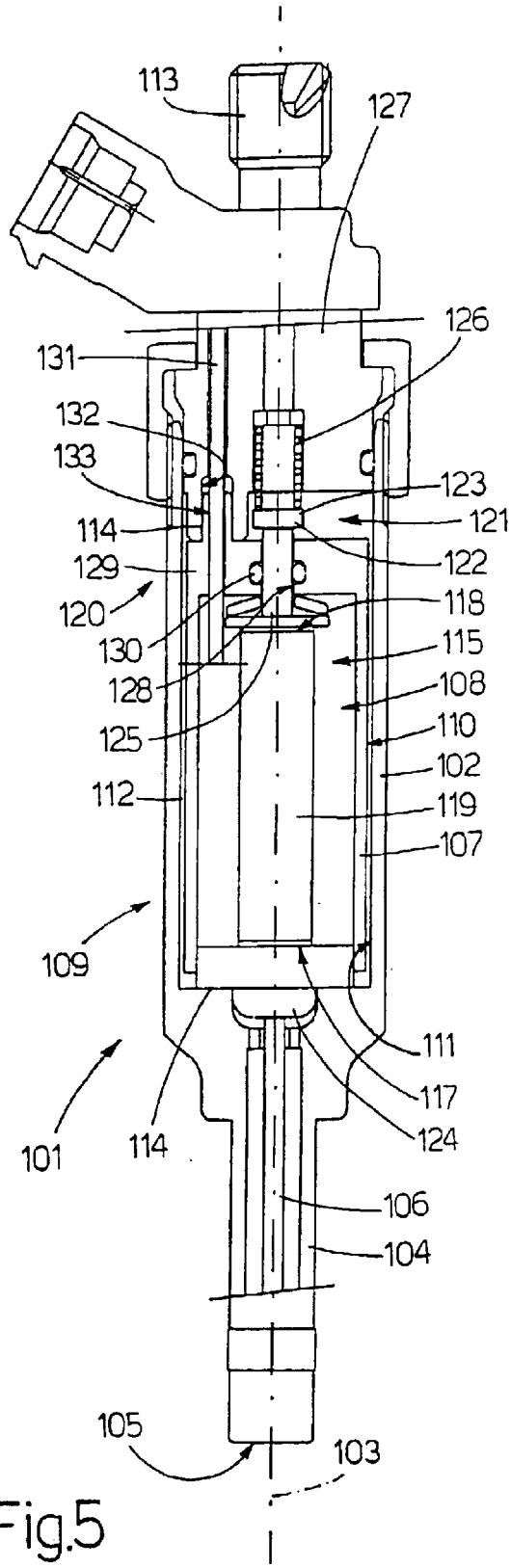
FIG. 5 is a partial section along the line V—V of the injector in FIG. 4 [sic]
Figure 4:
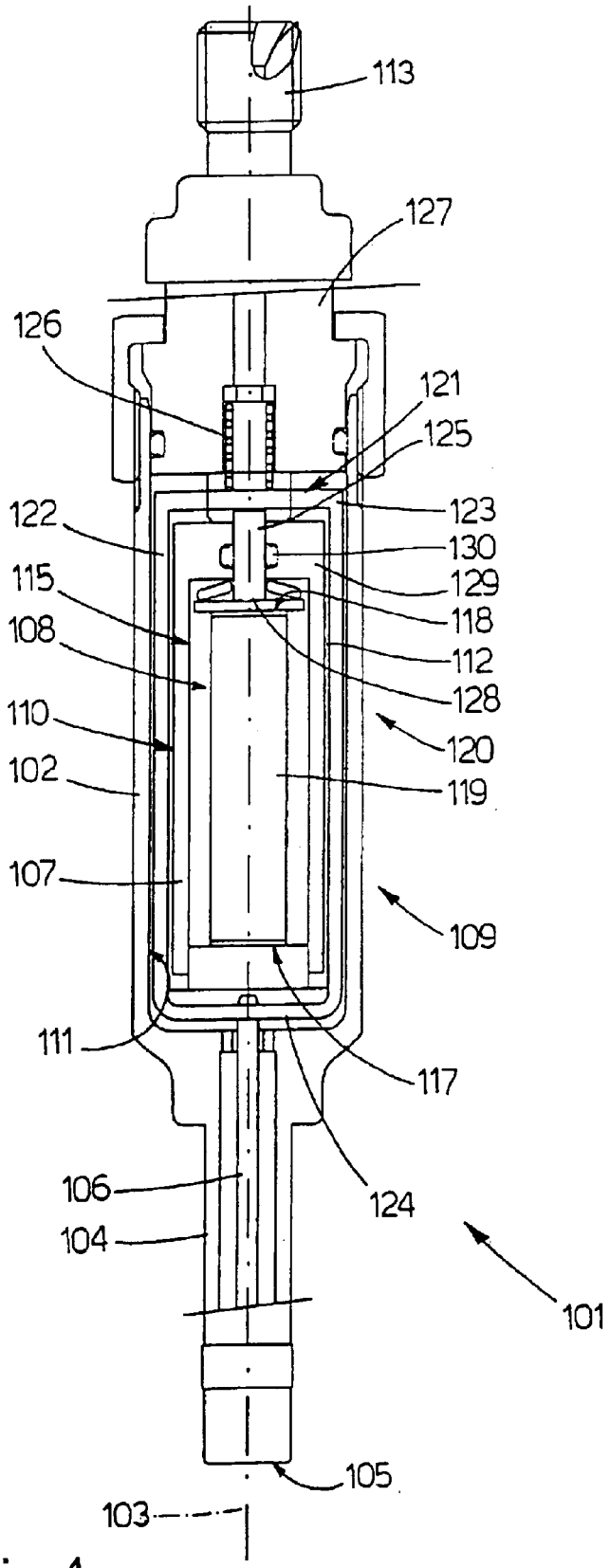
FIG. 4 is a partial section along the line IV—IV of the injector in FIG. 4 [sic]

In FIGS. 3, 4 and 5 the reference number 101 indicates a fuel injector as a whole, which comprises a container 102 substantially cylindrical in shape, having a central axis of symmetry 103 and a circular section; in correspondence with a lower end of the container 102 there is attached an injection pipe 104, which is in the form of a cylindrical tube and ends in an injection port 105 regulated by a valve 106 that is moveable along the axis 103 between a closed position and an open position. Inside the container 102 there is arranged, coaxially with the axis 103, a container 107, which is cylindrical in shape, has an elliptical section and is provided with an internal chamber 108 that houses a piezoelectric actuator 109 capable of activating the valve 106, i.e. capable of displacing the valve 106 between the aforementioned closed and open positions.

The container 107 has a dimension transverse to the axis 103 that is smaller than the container 102 so as to constitute, between the outer lateral surface 110 of the container 107 and the inner lateral surface 111 of the container 102, an annular channel 112 through which the fuel can flow freely in a direction parallel to the axis 103 until it reaches the mouth of the injection pipe 104; in particular, the fuel is supplied under pressure to an upper portion of the annular channel 112 through a supply pipe 113 ending inside the container 102.

The container 107 is integral with the container 102 by way of a contact zone 114 produced by welding or similar, so that the container 107 constitutes a fixed frame for the piezoelectric actuator 109; the piezoelectric actuator 109 comprises an actuator body 115 made of piezoelectric material, which is arranged in alignment with the axis 103, has a lower base 117 arranged close to the valve 106 and linked to the container 107, and has an upper base 118 opposite the lower base 117 and free to slide with respect to the container 107 along the axis 103. The actuator body 115 is constituted by a single component 119 made of piezoelectric material arranged coaxially to the central axis 103.

Between the mobile upper base 118 and the valve 106 there is placed a mechanical transmission 120 provided with mobile equipment 121, which is arranged in contact with the upper base 117 and is connected rigidly to the valve 106; in particular, the mobile equipment 121 comprises a ring component 122 substantially rectangular in shape, which is moveable along the axis 3, is arranged around the actuator body 115 and the container 107, has an upper transverse side 123 arranged in contact with the upper base 118, and a transverse side 124 opposite the transverse side 123 and connected rigidly to the valve 106.

In particular, the ring component 122 is arranged so as to bear against the upper base 118 by means of the interposition of a cylindrical body 125, and is kept bearing against the upper base 118 itself by the pressure exerted along the axis 103 by a spring 126 compressed between the upper transverse side 123 and an upper portion 127 of the container 102. The cylindrical body 125 is arranged so as to pass through a hole 128 in the upper portion 129 of the container 107 and is coupled to the hole 128 itself by means of a holding component 130.

In order to drive the actuator body 115, electric voltage is supplied to the actuator body 115 itself via an electrical cable 131, which passes through an appropriate open hole 132 of the container 102 and through an appropriate open hole 133 of the container 107, which is coupled in a fluid-tight manner with the hole 132. In use, when the actuator body 115 is non-excited, i.e. is not subject to an electrical field, the valve 106 is in the aforementioned closed position in that it is pushed downwards along the axis 103 by the pressure exerted by the spring 126 and transmitted to the valve 106 by the ring component 122.

When the actuator body 115 is excited, i.e. is subject to an electrical field, the actuator body 115 itself expands along the axis 103; for the purposes of this expansion the lower base 117 stays still, since it is linked to the container 107, while the upper base 118 performs an upward displacement along the axis 103, which displacement is transmitted to the valve 106 by the cylindrical body 125 and the ring component 122 and causes a displacement of the valve 106 along the axis 103 from the aforementioned closed position to the aforementioned open position.

Figure 6:
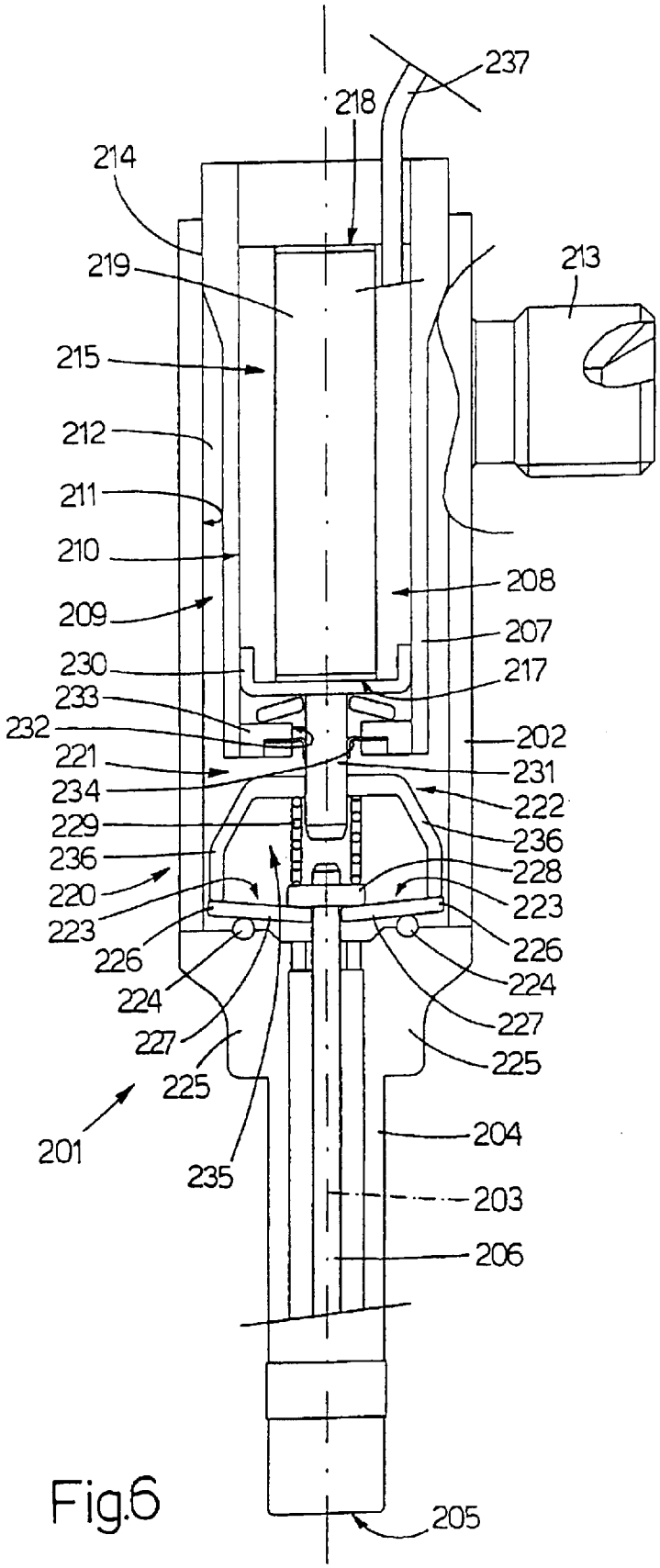
FIG. 6 is a diagrammatic view, in side elevation and partial section, of another embodiment of a fuel injector produced according to the present invention.

In FIG. 6, the reference number 201 indicates a fuel injector as a whole, which comprises a container 202 substantially cylindrical in shape, having a central axis of symmetry 203 and a circular section; in correspondence with a lower end of the container 202 there is attached an injection pipe 204, which is in the form of a cylindrical tube and ends in an injection port 205 regulated by a valve 206 that is moveable along the axis 203 between a closed position and an open position. Inside the container 202 there is arranged, coaxially with the axis 203, a container 207, which is cylindrical in shape, has an circular section and is provided with an internal chamber 208 that houses a piezoelectric actuator 209 capable of activating the valve 206, i.e. capable of displacing the valve 206 between the aforementioned closed and open positions.

The container 207 has a diameter, i.e. a dimension transverse to the axis 203, that is smaller than the container 202 so as to constitute, between the outer lateral surface 210 of the container 207 and the inner lateral surface 211 of the container 202, an annular channel 212 through which the fuel can flow freely in a direction parallel to the axis 203 until it reaches the mouth of the injection pipe 204; in particular, the fuel is supplied under pressure to an upper portion of the annular channel 212 through a supply pipe 213 ending inside the container 202.

The container 207 is integral with the container 202 by way of a contact zone 214 produced by welding or similar, so that the container 207 constitutes a fixed frame for the piezoelectric actuator 209; the piezoelectric actuator 209 comprises an actuator body 215 made of piezoelectric material, which is arranged in alignment with the axis 203, has a lower base 217 arranged close to the valve 206 and free to slide with respect to the container 207 along the axis 203, and has an upper base 218 opposite the lower base 217 and linked to the container 207. The actuator body 215 is constituted by a single component 219 made of piezoelectric material arranged coaxially to the central axis 203.

Between the mobile lower base 217 and the valve 206 there is placed a mechanical transmission 220, which is capable of inverting the direction of displacement produced by the expansion of the piezoelectric actuator 209 along the axis 203 so that, to a first displacement produced by the expansion of the piezoelectric actuator 209 along the axis 203, there corresponds a second displacement of the valve 206 along the axis 203 in the opposite direction to the first displacement.

The mechanical transmission 220 is provided with mobile equipment 221, which is linked to the lower base 217 and connected to the valve 206, and is provided with a system 222 for inverting the rocking movement, which is capable to transforming a first displacement produced by the expansion of the piezoelectric actuator 209 along the axis 203 into a second displacement of the valve 206 along the axis 203 in the opposite direction to the first displacement.

The system 222 for inverting movement comprises a pair of rockers 223 arranged symmetrically on either side of the axis 203; each rocker 223 is supported on a respective fixed fulcrum 224 constituted by a spherical body projecting from a lower portion 226 of the container 202, and is provided with an arm 226 arranged in contact with the mobile equipment 221 and by an arm 227 arranged in contact with a counterpart component 228 integral with the valve 206.

The arms 226 and 227 of each rocker 223 bear against either the mobile equipment 221 or the counterpart component 228, and are held in that condition by the pressure exerted along the axis 203 by a spring 229 compressed between the mobile equipment 221 and the counterpart component 228.

In particular, the mobile equipment 221 comprises a plate 230 transverse to the axis 203 and integral with the lower base 217; integral with the plate 230 is a cylindrical body 231, which passes through an open hole 232 of a lower portion 233 of the container 207 with the interposition of a holding component 234. The body 231 supports a fork 235, with two symmetrical branches 236, each of which is held so as to bear against the end of a respective arm 226.

In order to drive the actuator body 215, electric voltage is supplied to the actuator body 215 itself via an electrical cable 237.

In use, when the actuator body 215 is non-excited, i.e. is not subject to an electrical field, the valve 206 is in the aforementioned closed position in that it is pushed downwards along the axis 203 by the pressure exerted by the spring 229.

When the actuator body 215 is excited, i.e. is subject to an electrical field, the actuator body 215 itself expands along the axis 203; for the purposes of this expansion the upper base 218 stays still, since it is linked to the container 207, while the lower base 217 performs a downward displacement along the axis 203, which displacement is transmitted to the valve 206 by the mechanical transmission 220 and causes a displacement of the valve 206 along the axis 203 from the aforementioned closed position to the aforementioned open position.

On the basis of the dimensional relationship between the arms 226 and 227 of each rocker 223, it is possible to impose a given transmission ratio less than, greater than or equal to unity on the mechanical transmission 220; in particular, as illustrated in FIG. 6, the mechanical transmission 220 has an amplification factor that amplifies the displacement produced by the expansion of the actuator body 15.

What is claimed is:

1. Fuel injector provided with a piezoelectric actuator, a valve activated by the piezoelectric actuator and regulating a fuel supply that flows in a working direction, and a mechanical transmission placed between the piezoelectric actuator and the valve; an expansion of the piezoelectric actuator displacing the valve in the working direction from a closed position to an open position; the mechanical transmission being capable of displacing the valve in the working direction from the closed position to the open position in an opposite direction (V1) to that (V2) of the fuel outlet; said piezoelectric actuator comprising a fixed frame and an actuator body made of piezoelectric material arranged in alignment with said working direction; the actuator body having a lower base, which is arranged close to said valve and is linked to the fixed frame, and an upper base, which is opposite the lower base and is free to slide with respect to the fixed frame in the working direction; said mechanical transmission comprising mobile equipment, which is arranged in contact with the upper base and is connected rigidly to said valve; said mobile equipment comprising a ring component substantially rectangular in shape, which is moveable in said working direction, is arranged around said actuator body, and has a first side arranged in contact with said upper base and a second opposite side, connected rigidly to said valve.

2. Injector according to claim 1, in which said mobile equipment bears against said upper base and is kept bearing against the upper base itself by the pressure exerted in said working direction by a spring compressed between the mobile equipment and said fixed frame.

3. Injector according to claims 1, in which said actuator body is provided with a central hole in alignment with said working direction; said mobile equipment comprising a plate, which is transverse to said working direction and is arranged in contact with said upper base, and a rod, which is integral with the plate, and arranged parallel to the working direction inside the central hole of the actuator body, and is connected rigidly to the valve.

4. Injector according to claim 3, in which said actuator body is constituted by a single tubular component made of piezoelectric material.

5. Injector according to claim 3, in which said actuator body is constituted by at least two components made of piezoelectric material, physically separated from one another and arranged symmetrically about a central axis parallel to said working direction.

6. Injector according to claim 5, in which said mobile equipment is mounted floating, so as to be free to perform small oscillations about an axis perpendicular to said central axis.

7. Injector according to claim 1, in which said first side is arranged in contact with said upper base by means of the interposition of a cylindrical body.

8. Injector according to claim 1, and comprising a container that houses the piezoelectric actuator in its own internal chamber isolated from the fuel, and has an outer surface bathed in the fuel itself.

9. Fuel injector provided with a piezoelectric actuator, a valve activated by the piezoelectric actuator and regulating a fuel supply that flows in a working direction, and a mechanical transmission placed between the piezoelectric actuator and the valve; an expansion of the piezoelectric actuator displacing the valve in the working direction from a closed position to an open position; the mechanical transmission being capable of displacing the valve in the working direction from the closed position to the open position in an opposite direction (V1) to that (V2) of the fuel outlet; said piezoelectric actuator comprising a fixed frame and an actuator body made of piezoelectric material arranged in alignment with said working direction; the actuator body having a lower base, which is arranged close to said valve and is linked to the fixed frame, and an upper base, which is opposite the lower base and is free to slide with respect to the fixed frame in the working direction; said mechanical transmission comprising mobile equipment, which is arranged in contact with the upper base and is connected rigidly to said valve; which said actuator body being provided with a central hole in alignment with said working direction; said mobile equipment comprising a plate, which is transverse to said working direction and is arranged in contact with said upper base, and a rod, which is integral with the plate, and arranged parallel to the working direction inside the central hole of the actuator body, and is connected rigidly to the valve; said actuator body being constituted by at least two components made of piezoelectric material, physically separated from one another and arranged symmetrically about a central axis parallel to said working direction; said mobile equipment being mounted floating, so as to be free to perform small oscillations about an axis perpendicular to said central axis.

10. Fuel injector provided with a piezoelectric actuator, a valve activated by the piezoelectric actuator and regulating a fuel supply that flows in a working direction, and a mechanical transmission placed between the piezoelectric actuator and the valve; an expansion of the piezoelectric actuator displacing the valve in the working direction from a closed position to an open position; the mechanical transmission being capable of displacing the valve in the working direction from the closed position to the open position in an opposite direction (V1) to that (V2) of the fuel outlet; said piezoelectric actuator comprising a fixed frame and an actuator body made of piezoelectric material arranged in alignment with said working direction; the actuator body having a lower base, which is arranged close to said valve and is linked to the fixed frame, and an upper base, which is opposite the lower base and is free to slide with respect to the fixed frame in the working direction; said mechanical transmission comprising mobile equipment, which is arranged in contact with the upper base and is connected rigidly to said valve; being provided at least one compensation component, which has thermal expansion suitable for compensating for the various heat expansions of the actuator body and the mobile equipment and is an integral part of said mobile equipment.

* * * * *